US006962456B2

(12) United States Patent
Larsen

(10) Patent No.: US 6,962,456 B2
(45) Date of Patent: Nov. 8, 2005

(54) WASHING BRUSH WITH INCORPORATED LIQUID RESERVOIR

(76) Inventor: Søren J. Larsen, Fenrisvej 16 Tune, Roskilde (DK) DK-4000

( * ) Notice: Subject to any disclaimer, the term of this patent is extended or adjusted under 35 U.S.C. 154(b) by 0 days.

(21) Appl. No.: 10/863,583

(22) Filed: Jun. 8, 2004

(65) Prior Publication Data

US 2005/0025561 A1 Feb. 3, 2005

Related U.S. Application Data

(63) Continuation of application No. PCT/DK02/00854, filed on Dec. 13, 2002.

(30) Foreign Application Priority Data

Dec. 13, 2001 (DK) ..... 2001 01867

(51) Int. Cl.[7] ..... A46B 11/04
(52) U.S. Cl. ..... 401/291; 401/276; 401/282
(58) Field of Search ..... 401/120, 189, 401/282–284, 286, 287, 276, 291

(56) References Cited

U.S. PATENT DOCUMENTS 1,596,358 A * 8/1926 Jones ..... 401/287
2,547,834 A * 4/1951 Perwas ..... 401/287
4,370,072 A 1/1983 Moffitt, Jr. ..... 401/276
4,826,340 A 5/1989 Rothweiler et al. ..... 401/279

FOREIGN PATENT DOCUMENTS

DE 352 295 C 4/1922
WO WO 97 27007 A 7/1997

* cited by examiner

*Primary Examiner*—Tuan Nguyen
(74) *Attorney, Agent, or Firm*—Klein, O'Neill & Singh, LLP; Howard J. Klein

(57) ABSTRACT

A brush (1) for washing objects such as automobiles includes a handle (2) and a body (3) with a compartment (4) for receiving washing fluid, such as water, and a number of brush tufts (5). A passage (7) allows introduction of washing fluid into the compartment and is covered by a plate (9) of flexible material, such as rubber, such that the washing fluid may enter the compartment when the brush is submerged in the fluid, but is prevented from exiting the compartment by the plate when the brush is in use for washing an object. Passages (11*a*) are provided for allowing washing fluid to exit the compartment to the tufts for washing. A ventilating passage (12) is provided for allowing air to exit and enter the compartment when washing fluid enters and exits the compartment, respectively.

14 Claims, 2 Drawing Sheets

WASHING BRUSH WITH INCORPORATED LIQUID RESERVOIR

This application is a continuation of applicant's co-pending International Application No. PCT/DK02/00854, filed Dec. 13, 2002.

FEDERALLY SPONSORED RESEARCH OR DEVELOPMENT

Not Applicable

BACKGROUND OF THE INVENTION

The present invention relates to a brush for use in washing an object, particularly for washing automobiles, and comprising a body having a compartment for containing a washing liquid, and scrubbing means such as brush bristles or hairs attached to a first surface portion of said brush, said body being provided with at least one first aperture or passage for allowing washing liquid to flow out of said compartment.

A brush of this type is known where water is led to the apertures by a hose connected thereto. Much of the water dispensed is wasted and creates a nuisance as well as an environmentally undesirable situation.

SUMMARY OF THE INVENTION

From German patent No. DE 817 134 a brush for dispensing water on loaves of bread is known having a water compartment incorporated communicating with apertures for distributing water on the loaves of bread. Water is filled into the compartment and the compartment is closed by a lid to avoid spilling the water when using the brush. This brush is difficult to use because the lid has to be removed, the water is to be filled into the compartment and the lid replaced for each time a charge of water is to be used. Furthermore, a brush of this type cannot be used for washing inclined surfaces or by means of vigorous scrubbing movements necessary for washing an object as the water will spill out past the lid during vigorous washing movements and/or if the position of the brush is not close to horizontal.

The object of the invention is to provide a brush of the type indicated where the waste of washing liquid during vigorous washing movements and/or washing of inclined or downwards facing surfaces is reduced to a minimum and the filling of washing liquid into the compartment is rendered efficient and easy to effect.

According to the invention, this object is achieved by providing the body with at least one second aperture or passage for fluid communication from the surface of said body to said compartment for introducing washing fluid into said compartment.

This second aperture should be of a relatively small size relative to the dimensions of the body and should preferably have a total flow passage cross sectional area of less than approximately 50 $cm^2$, more preferably 45 $cm^2$, more preferably 40 $cm^2$, more preferably 35 $cm^2$, more preferably 30 $cm^2$, more preferably 25 $cm^2$, more preferably 20 $cm^2$, more preferably 15 $cm^2$ and most preferably less than approximately 10 $cm^2$.

Hereby, the washing liquid can be introduced into the compartment simply by dipping the body of the brush into a reservoir of washing liquid, but the flow of washing liquid out of the compartment is reduced by the relatively small flow area size.

So as to reduce the wastage of washing liquid further and allow the brush to be used on inclined or even vertical surfaces, said body further is provided with washing liquid flow throttling means arranged at said second aperture for throttling or preventing return flow of washing liquid from said compartment through said second aperture.

Hereby, the tendency of the washing liquid to spill out of the compartment through the second aperture will be reduced and the washing liquid will to a large degree only be dispensed in the intended manner through the second (dispensing) apertures.

Although said body in the currently preferred embodiment is an integral portion of the brush, according to the invention said body may be releasably attached to said brush. Hereby, a standard brush may be provided with the body and be converted into a washing liquid dispensing brush.

In a currently preferred embodiment the brush comprises a body having a compartment for containing a washing liquid and scrubbing means such as brush bristles or hairs attached to a first surface portion of said body, said body being provided with:

- at least one first aperture or passage for fluid communication between said compartment and said first surface portion for dispensing washing fluid from said compartment, and
- at least one second aperture or passage for fluid communication from the surface of said body to said compartment for introducing washing fluid into said compartment.

This second aperture should be of a relatively small size relative to the dimensions of the body and should preferably have a total flow passage cross sectional area of less than approximately 50 $cm^2$, more preferably 45 $cm^2$, more preferably 40 $cm^2$, more preferably 35 $cm^2$, more preferably 30 $cm^2$, more preferably 25 $cm^2$, more preferably 20 $cm^2$, more preferably 15 $cm^2$ and most preferably less than approximately 10 $cm^2$.

In a currently preferred embodiment of the brush according to the invention, said throttling means comprise a non-return valve means, and preferably said throttling means comprise a plate of elastic material such as rubber having a size larger than the interior mouth of said second aperture and having one edge thereof attached to the inner wall surface of said compartment adjacent said mouth such that said plate in relaxed condition thereof substantially covers said mouth. This is a particularly simple and efficient way of avoiding that the washing liquid spills out through the first passage while still allowing automatic and rapid filling of the compartment when dipping the brush into a container with washing liquid.

Alternatively, said throttling means may comprise a plate having a size larger then the interior mouth of said second aperture and arranged for pivoting around axis between a first position wherein said plate allows flow of liquid through said second aperture into said compartment and a second position wherein said plate inhibits or prevents flow of liquid through said second aperture out of said compartment.

Further alternatively, said throttling means may comprise a ball-and-valve-seat type non-return valve arranged in said second aperture.

In a currently preferred embodiment of a brush according to the invention, the body is provided with at least one third aperture or passage for allowing air to exit said compartment when washing fluid flows into said compartment through said first aperture, said body preferably being provided with inward flow throttling means for preventing or inhibiting flow of air into said compartment such that when washing liquid is dispensed through said second apertures, under-pressure is built up in said compartment and/or with outward flow throttling means for preventing or inhibiting flow of washing fluid out of said compartment through said third aperture.

Hereby the flow of washing liquid into the compartment is not hindered by over pressure, because of the venting of air through the third (ventilating) aperture or passage, and washing liquid is prevented or hindered from flowing out of the ventilating aperture during the washing process and thereby wetting the hand or clothes of the user. Furthermore, the dispensing rate of the washing liquid may be reduced by the inward flow throttling means arranged in or adjacent the third ventilating passage thus prolonging the time period in which washing may take place during simultaneous supply of washing liquid to the bristles. The inward flow throttling means may comprise a non-return valve such as the ones dealt with above in connection with the throttling means associated with the second aperture.

Preferably, a plurality of said first apertures or passages are dimensioned and distributed such that the area of the outer mouths thereof per unit of area of said first surface portion increases in the direction inwards from the boundary of said first surface portion. Hereby it is achieved that a major part of the washing fluid is dispensed at a distance from the boundary of the bristles and thereby is available for the washing effect of the bristles and does not merely flow away beyond the boundary of the surface portion provided with bristles.

So as to achieve that the washing liquid engages the bristles and is applied to the surface to be washed in an efficient manner, said bristles or hairs may be arranged in tufts, and outer mouths of said first apertures or passages may be located within or adjacent said tufts. Hereby the washing liquid is dispensed to the bristles in said tufts and flows down said bristles to the surface to be washed.

Advantageously, said tufts may be fastened at one end thereof in an annular space of a nipple or bushing surrounding a central channel therein, said nipples or bushings being arranged in said outer mouths of said first apertures or passages such that washing fluid may be dispensed from said compartment through said central channel. Hereby, a particularly efficient dispensing of washing liquid to the bristles is achieved in a manner allowing for good quality control and secure fastening of the bristles to the surface of the brush.

In a further embodiment of the brush according to the invention it further comprises dispensing means for continuously or intermittently dispensing an additive material such as cleansing liquid, cleansing paste or cleansing powder such as soap, detergent or the like, preferably into said compartment for containing washing liquid. Hereby the washing process is more efficient and easy to perform.

Preferably, said dispensing means may comprise a flexible, compressible container for containing said additive material, and the brush may comprise a recess or hollow for receiving said dispensing means, said hollow or recess communicating with the interior of said compartment or the exterior of said brush, preferably at a point adjacent one of said tufts.

The invention further relates to a body as discussed above and adapted for being releasably attached to a brush.

BRIEF DESCRIPTION OF THE DRAWINGS

The invention will in the following be explained more in detail with reference to the accompanying drawings where various embodiments of the brush according the invention are shown, solely by way of example, and wherein:

Referring now to FIGS. 1 and 2, a brush indicated generally by the reference number 1 comprises a handle portion 2, a body portion 3 having an interior compartment 4 for receiving washing fluid such as water or water with detergent and a number of tufts of bristles or hairs attached to a substantially planar surface portion 6 of the body portion 3.

Figure 3:
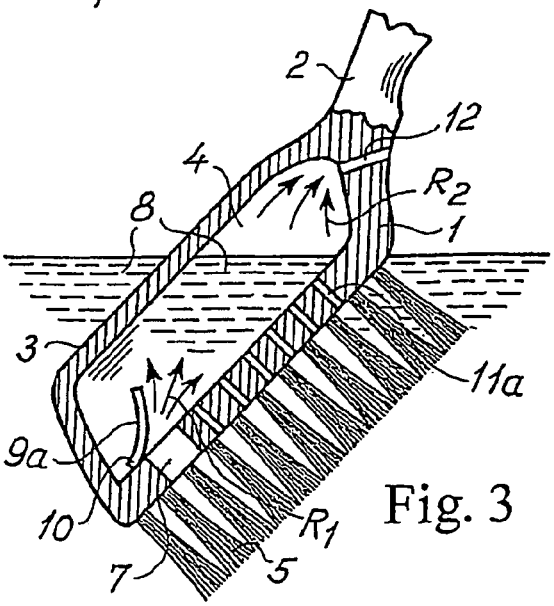
FIG. 3 is a diagrammatic, partly sectional view of the brush in FIG. 1 illustrating the introduction of washing fluid into the brush.

An aperture or passage 7 communicates the compartment 4 with the surroundings such that washing fluid may enter the compartment 4 when the brush 1 is submerged in a reservoir of washing fluid as shown in FIG. 3 where washing fluid 8 from a reservoir thereof enters the compartment 4 through aperture 7, as indicated by arrows R1.

Figure 1:
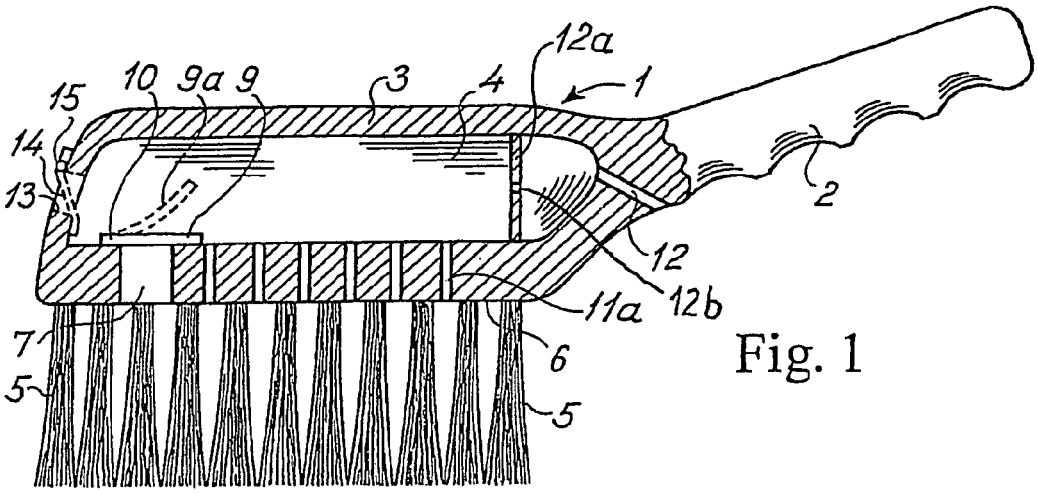
FIG. 1 is a diagrammatic, elevational, partly sectional view of a first, currently preferred embodiment of a brush according to the invention.

A plate or sheet 9 of a flexible material such as rubber is fastened to the inner surface of the compartment 4 at 10 adjacent the inner mouth of the aperture or passage 7 such that pressure from the washing fluid 8 in the reservoir urges the flexible plate to flex into the position 9*a* shown with dotted lines in FIG. 1 and full lines in FIG. 3 whereby washing fluid is allowed to enter the compartment 4 through the passage 7 as indicated by arrows R1.

When the brush 1 is taken out of the reservoir of washing fluid 8, the flexible plate 9 will revert to the position shown in full lines in FIG. 1 where the plate 9 covers the interior mouth of the passage 7 such that washing fluid in the compartment is inhibited or prevented from flowing out through the passage 7.

The flexible plate 9 thus functions as a non-return or one-way valve allowing washing fluid to enter the compartment 4 when the brush 1 is dipped in a reservoir of washing fluid 8, and inhibiting or preventing washing fluid to flow out of the compartment 4 when the brush 1 is removed from the reservoir of washing liquid and is applied to the surface to be washed, for example the surface of an automobile or any other surface to be washed such as a floor, a wall, a bath tub or the like.

Apertures or passages 11*a* and 11*b* communicating the compartment 4 with the surface portion 6 of the body 3 are provided for allowing washing fluid 8 to be dispensed to said surface portion 6 when the brush 1 is held in a suitable position for washing a surface such that the pressure of washing liquid in the compartment urges the washing fluid through said passages 11*a* and 11*b*.

Figure 2:
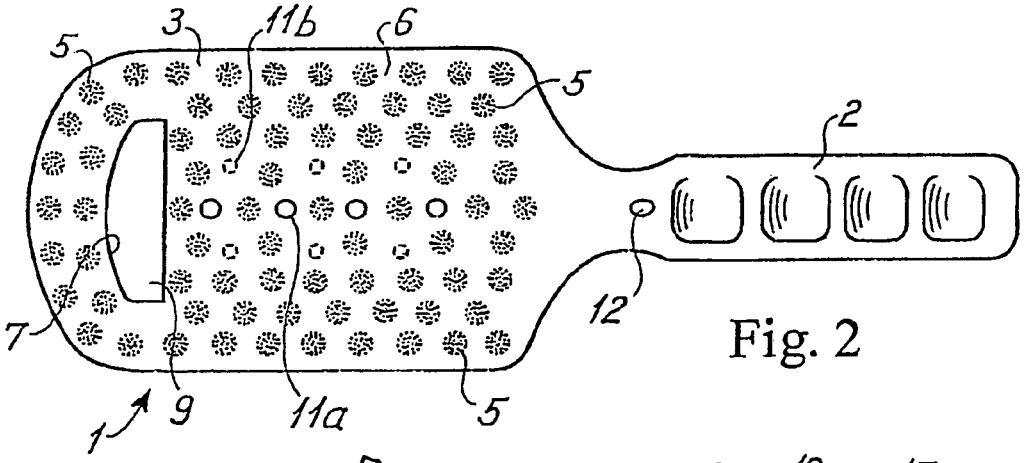
FIG. 2 is a bottom plan view of the brush shown in FIG. 1.

As shown in FIG. 2, the passages 11*a* have a larger cross sectional diameter than the passages 11*b* arranged closer to the boundary of the surface portion 6 whereby the washing fluid is dispensed more heavily in regions remote from said boundary so that the washing fluid dispensed is applied to the surface at a central region of the bristles 5 so that maximum efficiency of the washing fluid is obtained. The passages 11*a* and 11*b* may be distributed over the entire surface portion 6 or in other ways such that more washing fluid is dispensed in the central region of the surface portion 6 than at the edge regions of the surface portion 6.

A ventilation aperture or passage 12 is provided at the end of the compartment remote from the passage 7. The ventilation passage 12 allows air to leave the compartment when washing fluid is entering, as indicated by arrows R2 in FIG. 3. When washing fluid is being dispensed through passages 11*a* and 11*b*, the ventilation aperture or passage 12 allows air to enter the compartment in a direction opposite the arrows R2 in FIG. 3.

Hereby build-up of over and under pressure in the compartment 4 is avoided such that flow of washing liquid into and out of the compartment is not hindered by said over and under pressure.

However, it may be advantageous to arrange a throttling means, for instance a non-return valve of the types mentioned above and below, in or adjacent ventilating passage 12 such that flow of air into the compartment 4 is hindered or prevented during dispensing of washing liquid because under pressure or vacuum is built up in the compartment 4. Hereby the rate of flow of washing liquid through the apertures 11*a* and 11*b* will be reduced thereby prolonging the time period in which washing may take place with the brush 1 during simultaneous supply of washing liquid to the bristles 5. This effect may also be achieved by arranging the outer mouth of the passage 12 such relative to the handle that said outer mouth of passage 12 may be covered by a finger of a user during washing such that the finger functions as a non-return valve preventing air-flow through ventilating passage 12 into compartment 4.

So as to prevent washing fluid from exiting through passage 12 and causing wetting of the user's hand and clothes, an impediment to the flow of washing fluid to the passage 12 may be provided such as a partition wall 12*a* having a ventilating aperture 12*b* provided through said wall 12*a* for allowing air to enter compartment 4, while wall 12*a* impedes or hinders washing fluid from exiting through passage 12.

Various other means such as a labyrinth or a one-way valve may be provided for the function of impeding, hindering or reducing exit of washing fluid through a ventilating means such as passage 12.

In FIG. 1 an alternative embodiment of a non-return valve is shown arranged at the front of the body 3 in a passage 13 where a rigid plate member 14 is arranged around a pivot 15 such that the plate 14 rotates counter-clockwise when the brush is submerged in a reservoir of washing liquid and thereby does not obstruct the passage 13, while it rotates clockwise to the position shown in FIG. 1 when the brush is in use and washing liquid is in the compartment 4; in which position the plate 14 abuts the inner surface of the compartment adjacent the passage 13 and the plate 14 thereby obstructs the passage 13 thus inhibiting or preventing flow of washing liquid from the compartment through said passage 13.

Other non-return valve means may be employed, for example ball-and-valve-seat type non-return valves may be located in an aperture corresponding to aperture 7 or 13 or in passage 12. Labyrinths are also useful in this respect.

Figure 4:
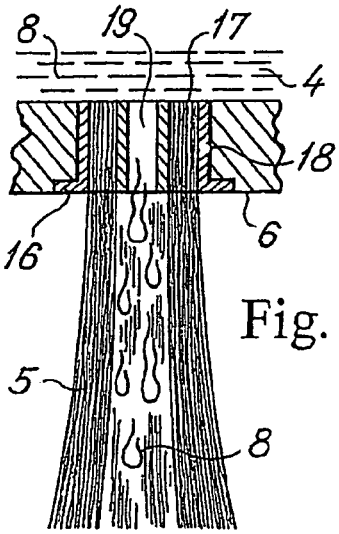
FIG. 4 is a diagrammatic, enlarged scale, fragmentary view of an embodiment of a bristle tuft combined with a washing fluid dispensing aperture according to the invention.

Referring now to FIG. 4, a nipple or bushing 16 having an annular space 17 wherein one end of all the bristles of a tuft 5 are inserted and fastened is arranged in an aperture or passage 18 communicating the compartment 4 with the surface portion 6, the washing liquid 8 being dispensed through a central channel 19 in the nipple or bushing 16 such that the washing liquid 8 flows down along the bristles of the tuft 5, the washing liquid thus being applied to the surface to be washed in an efficient manner.

This effect may also be achieved by boring the apertures 11*a*, 11*b* in the middle of or adjacent a tuft of bristles 5 fastened in a conventional manner in the body 3, the bored aperture 11*a*, 11*b* thus removing some of the bristles in the tuft. This embodiment is simple and cheaper to manufacture, but has the disadvantage that some of the bristles of the tufts involved are removed.

The brush may be designed for many other uses, for instance as a scrubbing brush being brushed for scrubbing floors where the handle is much longer and where the aperture for introducing washing liquid into the compartment is arranged in the top surface of the body in which case the non-return valve means may be dispensed with because the washing liquid introduction aperture is arranged at the top of the body and the scrubbing brush is intended solely for use in a horizontal position.

It is likewise within the scope of the invention that the bristles are replaced by other scrubbing means, such as strips of cloth (mops) or textiles cloth arranged across the surface 6 perhaps combined or substituted by a sponge body arranged on or adjacent surface portion 6 of the body 3.

The compartment 4 may be located in many different ways relative to the handle and the surface portion 6 carrying the bristles, the location and configuration of the compartment being determined by the specific use of the brush thus configured.

Figure 5:
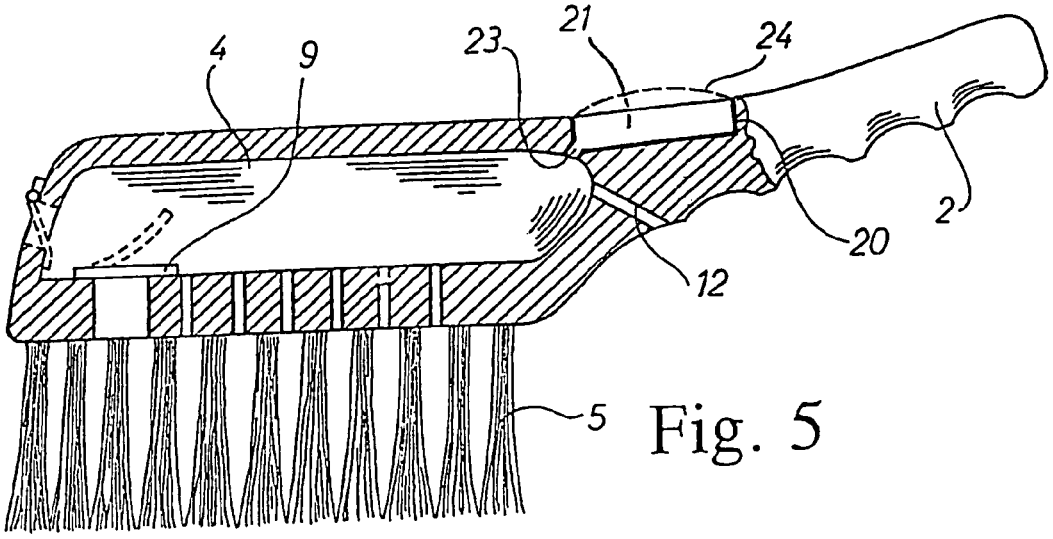
FIG. 5 is a diagrammatic, elevational, partly sectional view of a second embodiment of a brush according to the invention with a recess for receiving a liquid dispensing container.
Figure 6:
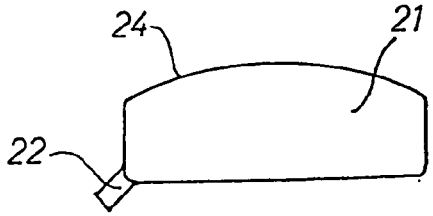
FIG. 6 is a schematic, elevational, outline, enlarged scale view of a liquid dispensing container for use with the brush in FIG. 5.

Referring now to FIGS. 5–6, the brush of FIGS. 1–2 has been modified to comprise a recess 20 in the handle 2 for receiving a container 21 (FIG. 6) shown in dotted lines in FIG. 5 for dispensing a second washing fluid such as liquid soap, detergent, insect remover or other cleansing composition through a nozzle 22 located in a passage 23 communicating compartment 4 with recess 20.

The walls of the container 21 or at least an upwardly convex or domed wall portion 24 thereof is made of a flexible material such as rubber or polyethylene so that a cleansing liquid inside the container 21 may be pressed out through the nozzle 22 by applying finger pressure to the domed portion 24 such that one or more doses of cleansing liquid may be injected into the washing fluid in the compartment 4.

The dispensing means for dispensing one or more doses of cleansing composition such as liquid soap or a soap paste into the compartment 4 of the brush may comprise a piston mechanism located in a cylinder containing the soap and arranged in a recess similar to recess 20 and adapted for being activated by a finger.

Figure 7:
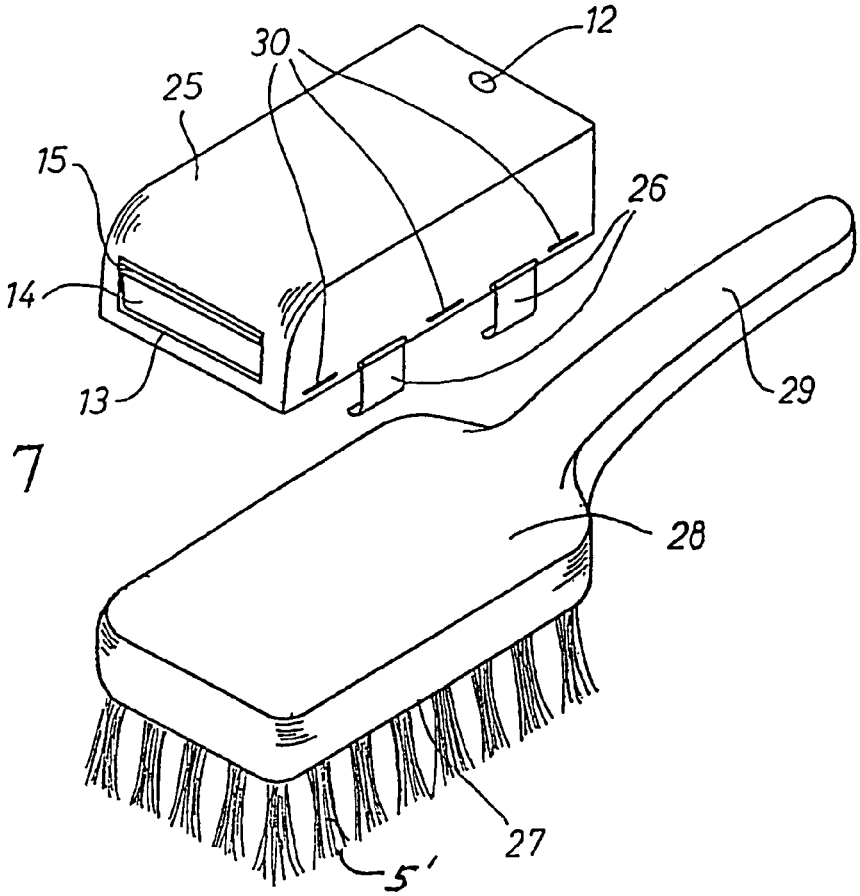
FIG. 7 is a diagrammatic, perspective view of a third embodiment of a brush according to the embodiment comprising a releasable container according to the invention adapted for attachment to a standard brush.

Referring now to FIG. 7 a separate container 25 for washing fluid such as water is provided with a non-return valve like the one in the front surface of the brush of FIG. 1 comprising a passage 13 with a plate member 14 arranged pivotable around a pivot 15 for allowing water to enter the interior of the container 25 like in the FIG. 1 embodiment. A ventilating passage 12 is likewise provided.

The container 25 is provided with four hook members 26 for attaching the container 25 to the bottom edge 27 of a standard brush 28 having a handle 29 and brush tufts 5'. Aperture slits 30 are provided on either side of the container for allowing water inside the container 25 to flow out while washing the surface to be washed with the brush 28.

The attachment hooks 26 may be substituted by other attachment means either solely attached to the container 25 such as rubber bands intended to extend along the bottom surface of the brush 28 between the tufts 5' or by cooperating attachment means arranged on both the container 25 and the brush 28 such as Velcro® hook and loop attachment means or a groove in the upper surface of brush 28 adapted to slidingly receive one or more projections on the bottom surface of container 25.

What is claimed is:

1. A brush for use in washing an object, particularly for washing automobiles, and comprising a body having a compartment for containing a washing liquid, and scrubbing means attached to a first surface portion of said brush, said body comprising:

at least one first aperture or passage for allowing washing liquid to flow out of said compartment, at least one second aperture or passage for fluid communication from the exterior of said body to said compartment for introducing washing fluid into said compartment, and means arranged at said second aperture for inhibiting or preventing return flow of washing liquid from said compartment through said second aperture, wherein said second aperture has an interior mouth having an area, and wherein the means for inhibiting or preventing return flow comprises a plate having an area larger than the area of the interior mouth of said second aperture and having one edge thereof attached to the inner wall surface of said compartment adjacent said interior mouth such that said plate is movable between a first position that covers said interior mouth and a second position that uncovers said interior mouth.

2. A brush for use in washing an object, particularly for washing automobiles, and comprising a body having a compartment for containing a washing liquid and scrubbing means attached to a first surface portion of said body, said body comprising:

at least one first aperture or passage for fluid communication between said compartment and said first surface portion for dispensing washing fluid from said compartment, at least one second aperture or passage for fluid communication from the surface of said body to said compartment for introducing washing fluid into said compartment, and means arranged at said second aperture for inhibiting or preventing return flow of washing liquid from said compartment through said second aperture, wherein said second aperture has an interior mouth having an area, and wherein the means for inhibiting or preventing return flow comprises a plate having an area larger than the area of the interior mouth of said second aperture and having one edge thereof attached to the inner wall surface of said compartment adjacent said interior mouth such that said plate is movable between a first position that covers said interior mouth and a second position that uncovers said interior mouth.

3. The brush according to claim 2, wherein the body a plurality of said first apertures or passages, each having an outer mouth, wherein the first apertures or passages are dimensioned and distributed such that the area of the outer mouths thereof per unit of area of said first surface portion increases in the direction inwards from the boundary of said first surface portion.

4. The brush according to claim 2, wherein the body a plurality of said first apertures or passages, each having an outer mouth, wherein said scrubbing means comprise bristles or hairs are arranged in tufts and wherein the outer mouths of said first apertures or passages are located within or adjacent said tufts.

5. The brush according to claim 4, wherein each of said tufts is fastened at one end thereof in an annular space of a nipple or bushing surrounding a central channel therein, said nipples or bushings being arranged in said outer mouths of said first apertures or passages such that washing fluid may be dispensed from said compartment through said central channel.

6. The brush according to either of the claims 1 or 2, wherein said means for inhibiting or preventing return flow comprise a non-return valve means.

7. The brush according to either of the claims 1 or 2, wherein the plate is made of an elastic material and said plate in a relaxed condition thereof substantially covers said mouth.

8. The brush according to either of the claims 1 or 2 wherein the plate is arranged for pivoting around an axis between said first position and said second position.

9. The brush according to either of the claims 1 or 2, wherein the body includes at least one third aperture or passage for allowing air to exit said compartment when washing fluid flows into said compartment through said first aperture, said body further including means for preventing or inhibiting flow of air into said compartment such that when washing liquid is dispensed through said second apertures, an under-pressure is built up in said compartment.

10. The brush according to claim 9, further comprising means in said body for inhibiting the flow of washing liquid out of said compartment through said third aperture.

11. brush according to either of the claims 1 or 2, the body further comprising dispensing means for dispensing an additive material into said compartment for containing washing liquid.

12. The brush according to claim 11, wherein said dispensing means comprises a flexible, compressible container for containing said additive material.

13. The body further according to claim 11, wherein the brush comprises a recess or hollow for receiving said dispensing means, said hollow or recess communicating with the interior of said compartment.

14. The brush according to either of the claims 1 or 2, wherein said second aperture is of a relatively small size relative to the dimensions of said body and has a total flow passage cross sectional area of less than approximately 50 $cm^2$.

* * * * *